United States Patent [19]

Finnila

[11] Patent Number: 4,457,350

[45] Date of Patent: Jul. 3, 1984

[54] LUMBER PLANING MACHINE

[76] Inventor: John S. Finnila, 16223 143rd Pl. SE., Renton, Wash. 98055

[21] Appl. No.: 165,494

[22] Filed: Jul. 3, 1980

[51] Int. Cl.[3] ..... B27C 1/08; B27C 1/12

[52] U.S. Cl. ..... 144/117 R; 144/3 P; 144/246 F; 144/249 A

[58] Field of Search ..... 144/2 R, 3 R, 3 P, 114 R, 144/116, 117 R, 246 R, 246 F, 249 A

[56] References Cited

U.S. PATENT DOCUMENTS

| | | | |
|---|---|---|---|
| 1,670,360 | 5/1928 | Johnson | 144/3 P |
| 2,102,186 | 12/1937 | Nicholson et al. | 144/116 |
| 2,684,088 | 7/1954 | Miller | 144/41 |
| 2,819,744 | 1/1958 | Chuef et al. | 144/3 P |
| 3,082,802 | 3/1963 | Dickson et al. | 144/3 P |
| 3,373,782 | 3/1968 | Pease | 144/3 R |
| 3,920,058 | 11/1975 | Walker | 144/39 |
| 4,078,592 | 3/1978 | Standal | 144/39 |

*Primary Examiner*—W. D. Bray

*Attorney, Agent, or Firm*—Roy E. Mattern, Jr.

[57] ABSTRACT

A lumber planing machine with mechanisms in several embodiments whereby equal thickness planing cuts are very accurately taken from the top and bottom surfaces of sawed lumber with capability of planing at a high rate of speed while automatically adjusting for variation in lumber thickness, and while maintaining a high level of accuracy in the planed lumber dimensions, and yet returning to former methods of specific planing cuts on the bottom surface under special circumstances.

32 Claims, 14 Drawing Figures

LUMBER PLANING MACHINE

BACKGROUND OF THE INVENTION

As is known in the forest products industry, the need for more accurate machinery to produce standard size finished lumber products has increased as the cost of the timber resource used in making lumber products has increased in value. Moreover the increased accuracy must be preferably accompanied by increased speeds of overall operations.

Standard planing machines now in use take a fixed planing cut from the lumber with the bottom cutterhead with the remaining material being removed by the top cutterhead. The minimum bottom planing cut must be sufficient to remove sawing irregularities caused by the least accurate sawing machine in the sawmill, requiring the set cut from the lumber by the bottom cutterhead to be significantly greater than the very thin cut that would be required to cleanly plane the bottom of the most accurately sawed lumber from the sawmill. Because it is impractical to separate and separately plane the accurately sawed lumber and inaccurately sawed lumber from the sawmill it is necessary to set the depth of the bottom cutterhead planing cut sufficiently large to remove the most severe sawing irregularities, and thereby requiring that all sawing machines in the sawmill be set to saw lumber thickness with sufficient planing allowance for a heavy, i.e. deep, bottom cutterhead planing cut.

SUMMARY OF THE INVENTION

The sawed lumber planing machine and method of this invention reduce the previously required size of the sawed lumber to the minimum size requirement for each sawing machine in a sawmill, by individually centering each sawed lumber piece in this planer ahead of the top cutterhead, thereby taking a thin and equal planing cut from top and bottom surfaces of thin and accurately sawed lumber; and heavier and equal cuts from the top and bottom surfaces of thicker and less accurately sawed lumber. The ability to individually set each sawing machine in the sawmill to the minimum sawed lumber dimensions produces wood fiber savings valuable to the lumber manufacturer in terms of cost savings and valuable to the public in terms of resource savings.

Another problem solved by this invention is the reduction of surface damage to planed lumber during the planing operation. Standard planers now in use which take a fixed cut from the bottom surface of sawed lumber and a very heavy cut from the upper surface of sawed lumber produce excessive surface damage around knots and other irregularities resulting in reduced grade and associated economic loss. The practice of this invention reduces the surface damage to planed lumber by distributing the planing thickness equally between the top and bottom surfaces of sawed lumber thereby eliminating the very heavy planing cuts known to produce surface damage.

In addition to planing equally from top and bottom surfaces of the sawed lumber, this invention can be automatically set to take a fixed cut from the bottom surface of the lumber with the remaining planing stock removed by the top cutterhead, as is accomplished by conventional planers in current manufacture. This feature provides the means whereby sawed lumber can be surfaced on one side only as is required on some products in common manufacture. The method of planing whereby only one side is planed is by adjusting the bottom planing cut for a zero thickness cut, thereby planing the entire required thickness with the top cutterhead. In addition, this feature provides the means whereby large surface defect on the top surface of the sawed lumber can be removed by means of planing a thin planing cut with the bottom cutterhead and a thick planing cut with the top cutterhead.

Another object of this invention is to provide a very accurate lumber planing machine. To create such accuracy, components and a method are provided of sharpening cutterhead knives to a fixed plane, whereby the planing surfaces of the cutterheads are maintained accurately at the proper set position. In addition, to create such accuracy, a method and components are provided whereby the infeed and outfeed feed rolls are automatically set to a proper relationship with the cutterhead settings.

Other and further objects, features and advantages of this invention will become apparent to those skilled in the art from the reading of the detailed disclosure and the review of the drawings.

DETAILED DESCRIPTION OF THE INVENTION

Introduction

The invention concerns planing sawed lumber, with respect to various embodiments of components and various embodiments of method steps, wherein oncoming sawed lumber is automatically, accurately, quickly and reliably sensed, guided, centered, and equally cut planed on top and bottom, and planed on both sides and rapidly discharged during most planing operations. Yet, when necessary, the bottom plane cut automatically may be reduced, fixed, or eliminated by a zero setting, to plane special boards. Throughout all operations minimum wood waste is a major objective, while still creating excellent wood products at a very economical and safe rate of production, with accuracy being maintained by built in sharpening components and by special cutterhead positioners.

The Feed Rolls

Figure 1:
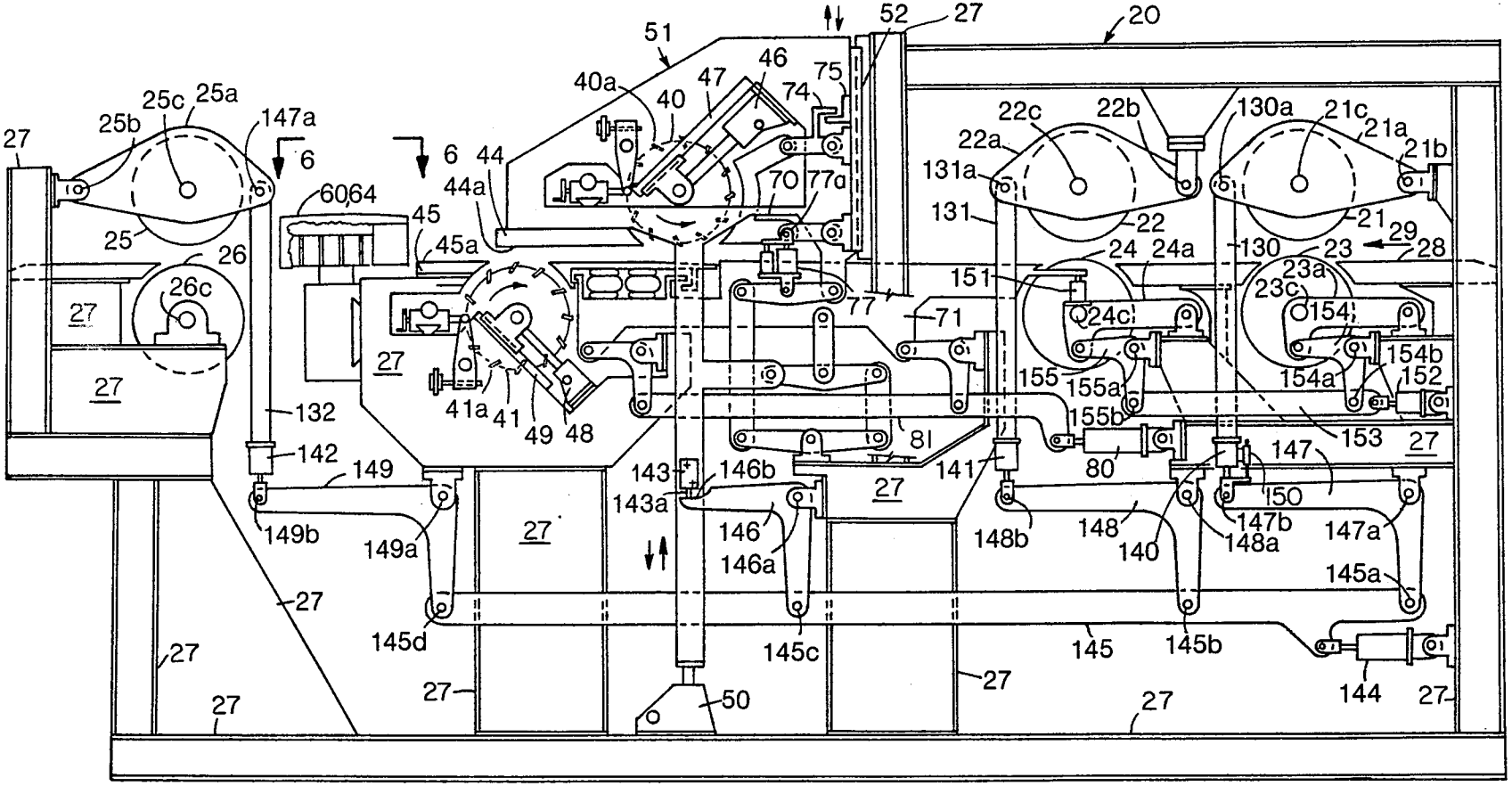
FIG. 1 is a side schematic elevation, with some portions broken away, of a preferred embodiment of a sawed lumber planing machine having automatic equal top and bottom planing capabilities.

As shown in FIG. 1, the method and components used in feeding sawed lumber through the equal planing machine 20 is by means of powered feed rolls 21, 22, 23, 24, 25 and 26, which are suspended from a common overall framing structure 27, of many parts, all designated by the numeral 27, that extend throughout this sawed lumber equal planing machine 20. These powered feed rolls are cylinders rotating about roll axis bearings 21*c*, 22*c*, 23*c*, 24*c*, 25*c* and 26*c* respectively. Sawed lumber enters the lumber planing machine at the infeed girt 28 and travels through this lumber planing machine in the direction shown by feed arrow 29 by means of the gripping powered feed rolls 21, 22, 23, 24, 25, and 26, which are rotating at substantially uniform speed relative to each other. The initially sawed lumber advances through the lumber planing machine to a position beyond fifth and sixth powered feed rolls 25 and 26, where an additional conveying machine, not shown and not forming a part of this invention, receives the planed lumber. The method of powering the powered feed rolls 21, 22, 23, 24, 25, and 26 can be by individual motors of various types or by a common chain or gear drive, which are well known in the art.

The Cutterheads

Figure 6:
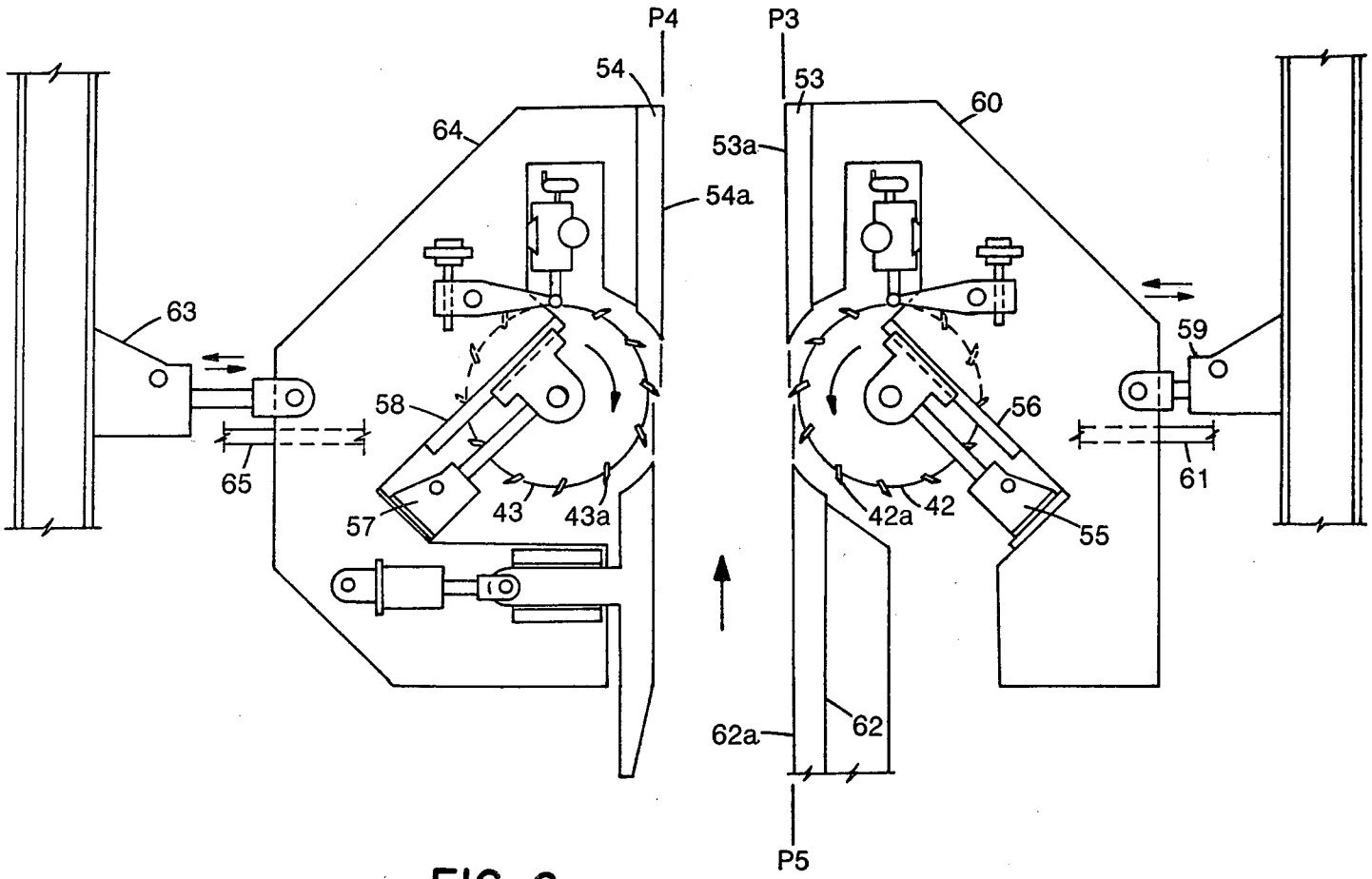
FIG. 6 is an enlarged partial top view, with some portions broken away, to illustrate the cutting adjustments of the side cutters, i.e. the inside and outer cutterheads, as viewed from line 6—6 in FIG. 1.

As shown in FIGS. 1 and 6, the four cutterheads providing the means whereby the sawed lumber surfaces are planed, are the top cutterhead 40, bottom cutterhead 41, inside side cutterhead 42, and outside side cutterhead 43, each with secured cutting knives 40*a*, 41*a*, 42*a*, and 43*a*. The method of securing these cutting knives in these cutterheads is well known in the art, such as by a locking gib pressing against these cutting knives or other means of generally conventional design.

Figure 2:
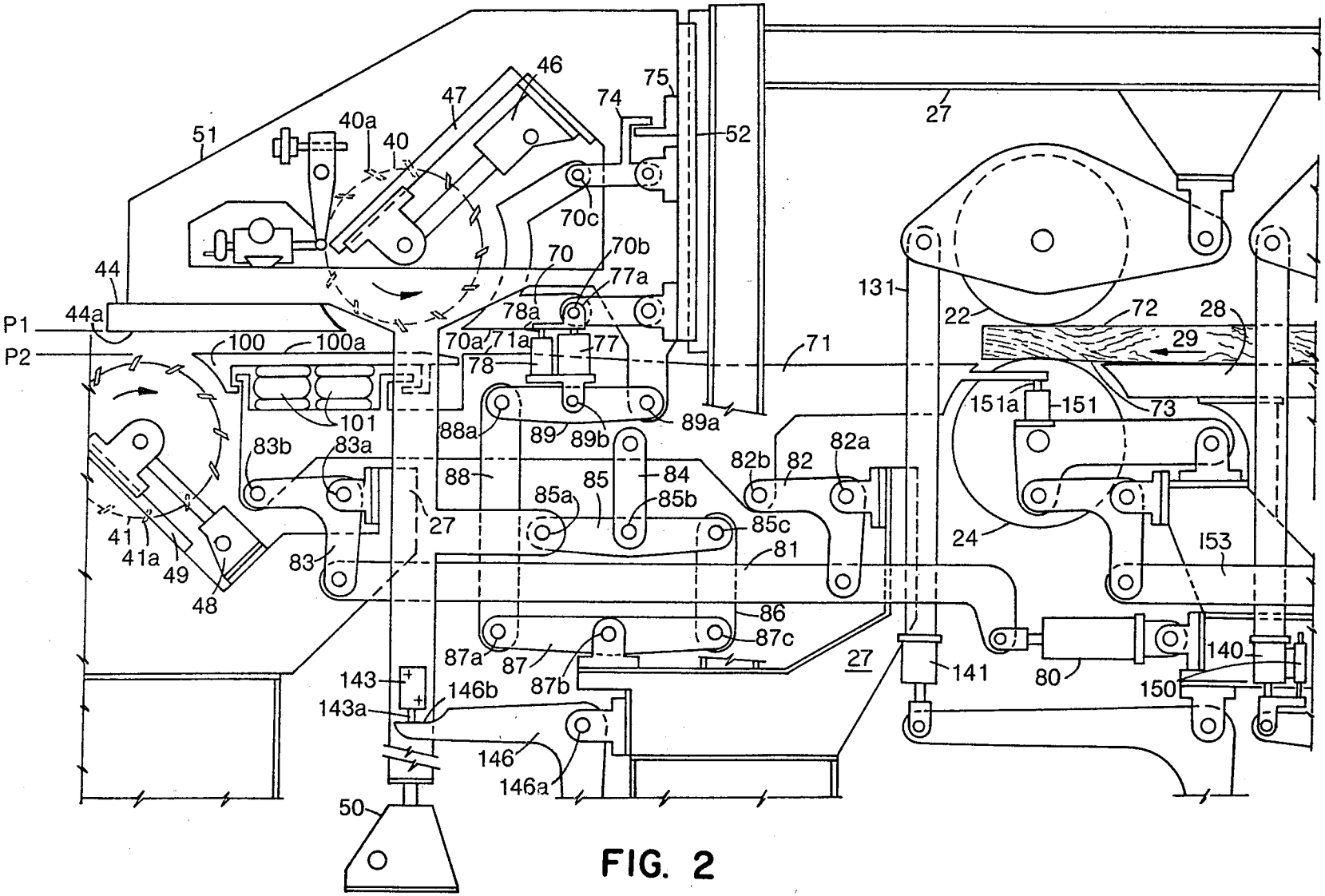
FIG. 2 is an enlarged partial schematic elevation with some portions broken away, of the preferred embodiment shown in FIG. 1.

Setting the Top and Bottom Cutters to Plane the Lumber to Selected Thickness The eventual resulting planed thickness of the originally sawed lumber is set by the distance between planes P1 and P2 shown on FIG. 2, whereby plane P1 is substantially in plane with the lower surface 44*a* on the top cutterhead pressure plate 44, and plane P2 is substantially in plane with the tangential planing surface of the bottom cutterhead 41. The dimensions between the plane P1 and the plane P2, are set by the position of the top cutterhead and the bottom cutterhead 41, provided the tangent points of the planing cuts of the cutterheads 40 and 41 are set substantially in plane with the lower surface 44*a* on the top cutterhead pressure plate 44 and the upper surface 45*a* on the bottom cutterhead tailplate 45 respectively.

Figure 8:
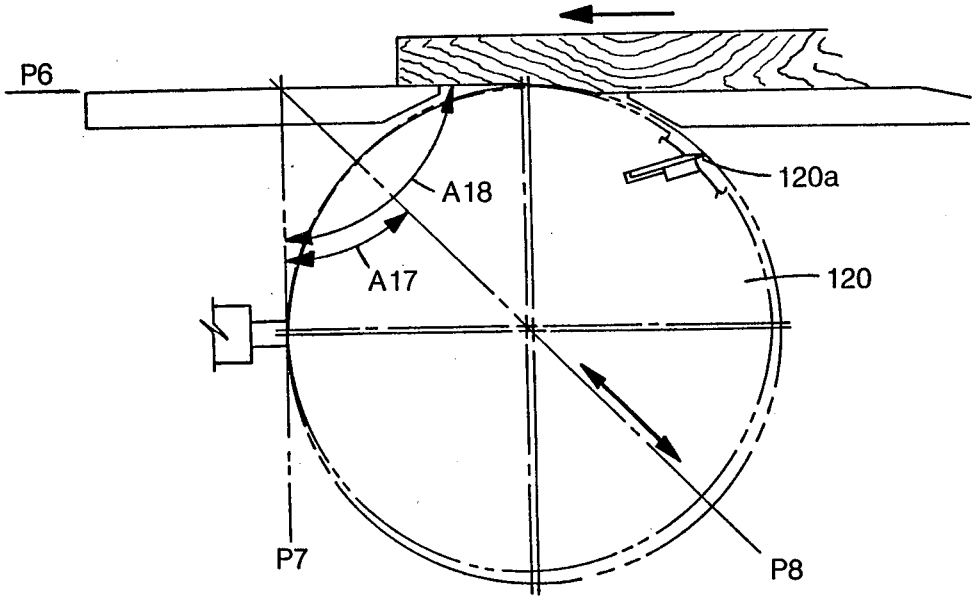
FIG. 8 is a partial enlarged schematic elevation with portions broken away, to illustrate how the cutterhead is moved on a forty five degree path in making contact with a reference structure such as at the sharpening locale of a jointer stone tip which in turn insures the rotating cutters will be cutting in the specified geometric plane.

As shown in FIGS. 1 and 8, the top cutterhead 40 is positioned, so the tangent point of the planing cut is substantially in plane with the lower surface 44*a* on the top cutterhead pressure plate 44, by means of the top cutterhead jointing jack 46, which traverses the top cutterhead 40 among the top forty five degree sloping jointing way 47 to this proper set position. The bottom cutterhead 41 is positioned, so the tangent point of the planing cut is substantially in plane with the upper surface 45*a* on the bottom cutterhead tailplate 45, by means of the bottom cutterhead jointing jack 48, which traverses the bottom cutterhead 41 along bottom forty five degree sloping jointing way 49 to this proper set position. With the top cutterhead 40 and bottom cutterhead 41 properly positioned, the thickness of the planed lumber is now substantially equal to the normal distance between the lower surface 44*a* on the top cutterhead tailplate 44, with this upper surface 45*a* on bottom cutterhead tailplate 45, being substantially fixed relative to overall framing structure 27. The top cutterhead pressure plate 44 is positioned by means of the thickness positioning jack 50 traversing the top cutterhead assembly 51 relative to the framing structure 27 along the top positioning way 52, whereby this positioning jack 50 substantially determines the thickness of the planed lumber.

Setting the Side Cutters to Plane the Lumber to Selected Width

FIG. 6 is a plan view of the inside side cutterhead 42, and the outside side cutterhead 43, and their adjoining components with respect to their location indicated by line 6—6 on FIG. 1. The width of the planed lumber is set by the distance between planes P3 and P4, in plane with inner surface 53*a* on inside side trailplate 53 and outer surface 54*a* on outside side tailplate 54 respectively. The dimensions between these planes P3 and P4 are in turn set by the position of the inside side cutterhead 42 and the outside side cutterhead 43, provided the tangent points of the planing cut of these cutterheads are accurately set as they will be, substantially in plane with inner surface 53*a* on inside side tailplate 53 and outer surface 54*a* on outside side tailplate 54 respectively.

The inside side cutterhead 42 is positioned, so the tangent point of the planing cut is substantially in plane with plane P3 by means of the inside jointing jack 55, which traverses the inside side cutterhead 42 along the inside forty five degree sloping jointing way 56 to the proper set position. The outside side cutterhead 43 is positioned so the tangent point of the planing cut is substantially in plane with plane P4 by means of the outside jointing jack 57, which transverses the outside side cutterhead 43 along the outside forty five degree sloping jointing way 58 to the proper set position. With the inside side cutterhead 42 and outside side cutterhead 43 properly positioned, the width of the planed board is substantially equal to the horizontal distance measured between and normal to inner surface 53*a* on inside side tailplate 53 and outer surface 54*a* on outside side tailplate 54. The inside side cutterhead 42 planing cut depth is set by the inside positioning jack 59 positioning the inside cutterhead assembly 60 along inside way 61 relative to guiding surface 62*a* on main guide 62, which guiding surface 62*a* is substantially in plane with plane P5, whereby the depth of cut is substantially the distance between planes P3 and P5 measured normal to the planes P3 and P5. The width of planed lumber is then set by the outside positioning jack 65 positioning the outside cutterhead assembly 64 along outside way 65 relative to the inside cutterhead assembly 60, whereby the width of the planed lumber is substantially determined by the distance set between inside side cutterhead 42 and outside side cutterhead 43, when the cutterheads 42 and 43 are properly positioned.

The Automatic Rapid Adjustment of the Infeed Rollers and Top and Bottom Platens to Equalize the Top and Bottom Planing Cuts The equal planing means whereby equal planing cuts are taken from the top and bottom surfaces of sawed lumber to create planed lumber with minimum waste is by means of an assembly of mechanical links and levers, and their actuation using hydraulic components such as valves, and cylinders. FIG. 2 is an enlarged view of these components utilized to create the positioning necessary to accomplish the equal planing cuts. Top platen surface 70*a* on top platen 70 and bottom platen surface 71*a* on bottom platen 71, position sawed lumber prior to this sawed lumber being planed by top cutterhead 40. With top cutterhead 40 and bottom cutterhead 41 properly positioned, the planes P1 and P2 determine substantially the planed top and bottom surfaces respectively of the planed lumber. Therefore the top platen surface 70*a* and bottom platen surface 71*a* must position the sawed lumber with the top lumber surface 72 and bottom lumber surface 73 equally spaced above plane P1 and below plane P2 respectively, to create equal planing cuts from the top and bottom surfaces of the lumber.

Figure 13:
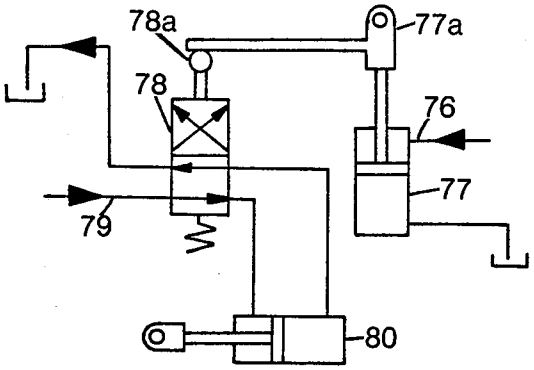
FIG. 13 is a schematic hydraulic diagram illustrating how the raising and lowering of the upper or top platen located ahead of the top cutterhead is sensed, and then the lower or bottom platen, also located ahead of the top cutterhead is equally respectively raised or lowered.

Top platen surface 70*a* is substantially in plane with plane P1 at the lowest position of top platen 70 occurring when upper platen arm 74 is in contact with upper stop 75, whereby means for the contact between upper platen arm 74 and upper stop 75 is provided by regulated fluid pressure source 76, as shown in FIG. 13, supplying a regulated and setable pressure fluid means to top platen cylinder 77. The top platen cylinder 77 is retracted, thereby lowering top platen 70 and in turn lowering upper platen arm 74 until the contact is made between upper platen arm 74 and upper stop 75, provided lumber or other objects are not present between top platen 70 and bottom platen 71 preventing this motion. Bottom platen surface 71*a* is substantially in plane with plane P2, when platen mechanical servo valve 78 is in the null position, and top platen surface 70*a* is substantially in plane with plane P1.

When top platen 70 is raised by lumber entering the gap between top platen surface 70*a* and bottom platen surface 71*a*, top platen cylinder clevis 77*a*, shown in FIG. 2 and also shown schematically on FIG. 13, raises platen servo valve stem 78*a* on platen mechanical servo valve 78 a distance substantially equal to the rise of top platen surface 70*a*, releasing high pressure fluid from high pressure fluid supply 79. Then the bottom platen cylinder 80 is retracted, whereby bottom platen link 81 retracts, rotating primary bell crank 82 about primary pivot 82*a* and secondary bell crank 83 about secondary pivot 83*a*, resulting in lowering bottom platen 71 equally at primary pin connection 82*b* and secondary pin connection 83*b*, with this equal lowering occurring by means whereby the geometry of primary bell crank 82 and secondary bell crank 83 are substantially of equal lever arms and shape.

Primary link 84 thereby lowers substantially equal to the lowering of bottom platen 71. Primary lever pin 85*b* on primary lever 85 lowers a distance substantially equal to said lowering of bottom platen 71, whereby primary lever pin 85*c* at the end of primary lever 85 lowers a distance substantially twice said lowering of bottom platen 71, which lowering is accomplished, by the distance from primary lever pin 85*a* to primary lever pin 85*c* being substantially twice the distance from primary lever pin 85*a* to primary lever pin 85*b*.

In turn, secondary link 86 lowers a distance equal to substantially twice the lowering of bottom platen 71 and secondary lever pin 87*c* on secondary lever 87 in turn lowers a distance substantially twice the lowering of bottom platen 71. Secondary lever pin 87*a* at the end of secondary lever 87 raises a distance substantially equal to twice the lowering of bottom platen 71, which rising distance is accomplished by the distance from secondary lever pin 87*a* to secondary lever pin 87*b* being substantially equal to the distance from secondary lever pin 87*b* to secondary lever pin 87*c*. Tertiary link pin 88*a* on tertiary link 88 thereby raises a distance substantially equal to twice said lowering of bottom platen 71. Tertiary lever pin 89*b* on tertiary lever 89 thereby raises a distance substantially equal to the lowering of bottom platen 71, which rising distance is accomplished by the distance from tertiary lever pin 89*b* to tertiary lever pin 89*a* being substantially one half the distance from tertiary lever pin 89*a* to tertiary link pin 88*a*.

Top platen cylinder 77 is thereby raised a distance substantially equal to the lowering of bottom platen 71, thereby raising the platen mechanical servo valve 78 equally until the null position of the platen mechanical servo valve 78 is reached. This null position is reached when the lowering of bottom platen 71 is equal to the rise of top platen 70, thereby insuring that the sawed lumber is equally positioned above plane P1 and below plane P2, and also thereby insuring equal planing cuts will be taken from the top and bottom surfaces of sawed lumber.

Utilization of Lower Pressure Hydraulic Fluid to Create Pressure Between Platens and of Higher Pressure Hydraulic Fluid to Quickly Adjust to Oncoming Different Thicknesses of the Sawed Lumber As shown in FIGS. 2 and 13, the force of top platen surface 70*a* on top lumber surface 72 of sawed lumber feeding through this lumber planing machine 20 is controlled by regulated fluid pressure source 76 supplying a regulated and setable pressure fluid means to top platen cylinder 77 thereby retracting the top platen cylinder 77 and lowering top platen 70 until top platen surface 70*a* is in contact with top lumber surface 72 of lumber being planed. The lumber then has its bottom lumber surface 73 directly in contact with bottom platen surface 71*a*, whereby the closing forces of top platen surface 70*a* and bottom platen surface 71*a* upon the top lumber surface 72 and bottom lumber surface 73 are substantially equal and directly opposed. These closing forces are substantially controlled and regulated via the movement of the top platen cylinder 77, and by the lower pressure regulated fluid pressure source 76. As described before, the bottom platen cylinder 80, which controls the position of bottom platen 71, is in turn positioned by means of platen mechanical servo valve 78, which directs hydraulic fluid flow from the higher pressure fluid supply 79.

A means is therefore provided to quickly and equally position the top platen surface 70*a* and bottom platen surface 71*a* for equal planing at a very high rate of speed, because this positioning means employs a high pressure fluid supply 79, supplying a loading means with resulting high positioning forces necessary for rapid and accurate positioning. While at the same time another cooperating means is independently employing a regulated fluid pressure source 76, supplying a means through top platen cylinder 77, whereby a relatively low and regulated force is applied to the top and bottom surfaces of the lumber being planed.

Advantages of These Equal Top and Bottom Planing Automatic Mechanisms

This equal planing means allows for equally planing from top and bottom surfaces of sawed lumber at a high rate of speed, for example at 1,000 feet per minute, through this lumber equal planing machine, while employing low contact forces on the lumber, thereby gently handling sawed lumber, and thereby preventing damage that would occur if high forces were applied to the lumber surfaces. In addition, this equal planing means positions the sawed lumber in a positive manner, whereby unequal forces on the lumber cannot move the lumber substantially from the setting position described for equal planing cuts planed from top lumber surface 72 and bottom lumber surface 73. Also the high pressure fluid supply 79 is substantially a non-compressible fluid to provide positive positioning of this equal planing means. This positive positioning of this equal planing means is in sharp contrast to other possible centering means, such as a spring centering system, whereby unequal forces on lumber, centered by such spring centering means would move the lumber from the center position, thereby resulting in unequal planing cuts on the top and bottom of the lumber.

This equal planing means also provides that this lumber planing machine can be set for various planed lumber thickness settings, while automatically maintaining equal planing cuts from the top lumber surface 72 and bottom lumber surface 73. During operations of this equal planing means, whereby equal planing cuts are automatically maintained, the bottom platen surface 71*a* is substantially maintained at its prior set position, when the top cutterhead assembly 51 is adjusted for various thickness settings.

Changing the Position of the Top Cutter to Change the Thickness of Planed Lumber When the top cutterhead assembly 51 is raised to plane thicker lumber or lowered to plane thinner lumber by means of thickness positioning jack 50, the top platen surface 70*a* is maintained substantially at the top platen surface 70*a*'s prior relative position to top cutterhead assembly 51, by means whereby upper platen arm 74 bears against upper stop 75. When this top cutterhead assembly 51 is positioned to a different planed lumber thickness setting, it is not important whether the position change was from a thin planed lumber setting to a thicker planed lumber setting or from a thick planed lumber setting to a thinner planed lumber setting, provided the change in position setting of the top cutterhead assembly 51 did not substantially change the position of bottom platen surface 71*a*.

The changed position setting of top cutterhead assembly 51 to be described will be from a thin planed lumber setting to a thicker planed lumber setting. When top cutterhead assembly 51 is raised by thickness positioning jack 50, top platen surface 70*a* is raised substantially the same distance as top cutterhead assembly 51 as previously described, whereby top platen cylinder clevis 77*a* is raised substantially the same distance as the rise of top platen surface 70*a*. Also the primary lever pin 85*a* is raised a distance substantially equal to the rise of top platen surface 70*a*, thereby lowering, via primary lever 85, the primary lever pin 85*c* a distance substantially equal to the rise of top platen surface 70*a*, which lowering is accomplished by the distance from primary lever pin 85*a* to primary lever pin 85*c* being substantially twice the distance from primary lever pin 85*a* to primary lever pin 85*b*. In turn, secondary link 86 lowers a distance substantially equal to the rise of top platen surface 70*a*, and secondary lever pin 87*c* in turn lowers a distance substantially equal to the rise of top platen surface 70*a*. Secondary lever pin 87*a* raises a distance substantially equal to the rise of top platen surface 70*a*, which rising distance is accomplished by the distance from secondary lever pin 87*a* to secondary lever pin 87*b* being substantially equal to the distance from secondary lever pin 87*b* to secondary lever pin 87*c* along the secondary lever 87. Tertiary link pin 88*a* on tertiary link 88 thereby raises a distance substantially equal to the rise of top platen surface 70*a* and tertiary lever pin 89*a* also raises a distance substantially equal to the rise of top platen surface 70*a*, whereby tertiary lever pin 89*b* raises a distance substantially equal to the rise of top platen surface 70*a*, which rise is accomplished by the two end points of tertiary lever 89 raising an equal distance. Top platen cylinder 77 and platen mechanical servo valve 78 thereby each raise a distance substantially equal to the rise of top platen surface 70*a*, and top platen cylinder clevis 77*a* also raises a distance substantially equal to the rise of top platen surface 70*a* as previously described, thereby resulting in substantially zero motion of platen servo valve stem 78*a* relative to platen mechanical servo valve 78. Therefore the bottom platen cylinder 80 is retained substantially at the same set position as prior to the raising of top cutterhead assembly 51, and in turn the bottom platen surface 71*a* is retained substantially at the same set position as prior to the raising of top cutterhead assembly 51, thereby providing the means whereby top platen surface 70*a* and bottom platen surface 71*a* are substantially retained in their required relative set positions, but to plane lumber at a different thickness, while still utilizing all the equal planing means.

A Floating Bottom Platen Presses the Top Planed Lumber Upwardly Against the Top Pressure Plate as the Lumber is Guided by the Bottom Cutterhead After the sawed lumber is equally positioned between top platen surface 70*a* and bottom platen surface 71*a*, top lumber surface 72 is planed by top cutterhead 40. Then following this top planing, the top surface of the lumber is pressed against lower surface 44*a* of top cutterhead pressure plate 44 by means of bottom floating platen surface 100*a* bearing against bottom lumber surface 73 of the lumber, whereby contact between bottom floating platen surface 100*a* and bottom lumber surface 73 is assured by allowing bottom floating platen 100 to raise or lower independently and relative to bottom platen 71. Bottom floating platen 100 is raised and lowered by floating platen positioner 101, which is fluid pressure loaded utilizing a variable and setable fluid pressure means, and which is of a sufficient range of travel, whereby bottom floating platen surface 100*a* will automatically adjust above and below bottom platen surface 71*a* to accommodate the maximum expected variation in lumber thickness expected to occur.

This means of pressing the lumber against lower surface 44*a* of top cutterhead pressure plate 44 provides the means, whereby the oncoming sawed lumber, with thickness variations from piece to piece, can be planed in end to end sequence, while maintaining the equal planing cuts. When the trailing end of the lumber being planed on top leaves the equal planing setting area between top platen surface 70*a* and bottom platen surface 71*a*, top platen 70 and bottom platen 71 immediately position the leading end of the next sawed lumber piece, which is entering the planing machine, with the quickly changed positioning of bottom platen 71 being successfully undertaken as it is functionally cleared of the floating positioning of bottom floating platen 100. Then the trailing end of the lumber moves on, while being pressed between bottom floating platen surface 100*a* and lower surface 44*a*, and it is thereby firmly positioned providing a solid lower wood surface against which the bottom cutterhead 41 planes the bottom lumber surface 73 of this lumber.

The planed bottom surface of the lumber leaves the bottom cutterhead 41 with this bottom planed surface being substantially in the plane with upper surface 45*a* on bottom cutterhead tailplate 45, when the bottom cutterhead 41 is properly positioned. Then the lumber enters the inside side cutterhead 42 and outside side cutterhead 43 area of this lumber planing machine, where the opposing edges of the lumber are planed. The lumber is now planed on all four sides and exits the equal planing machine by means of outfeed powered feed rolls 25 and 26.

Figure 3:
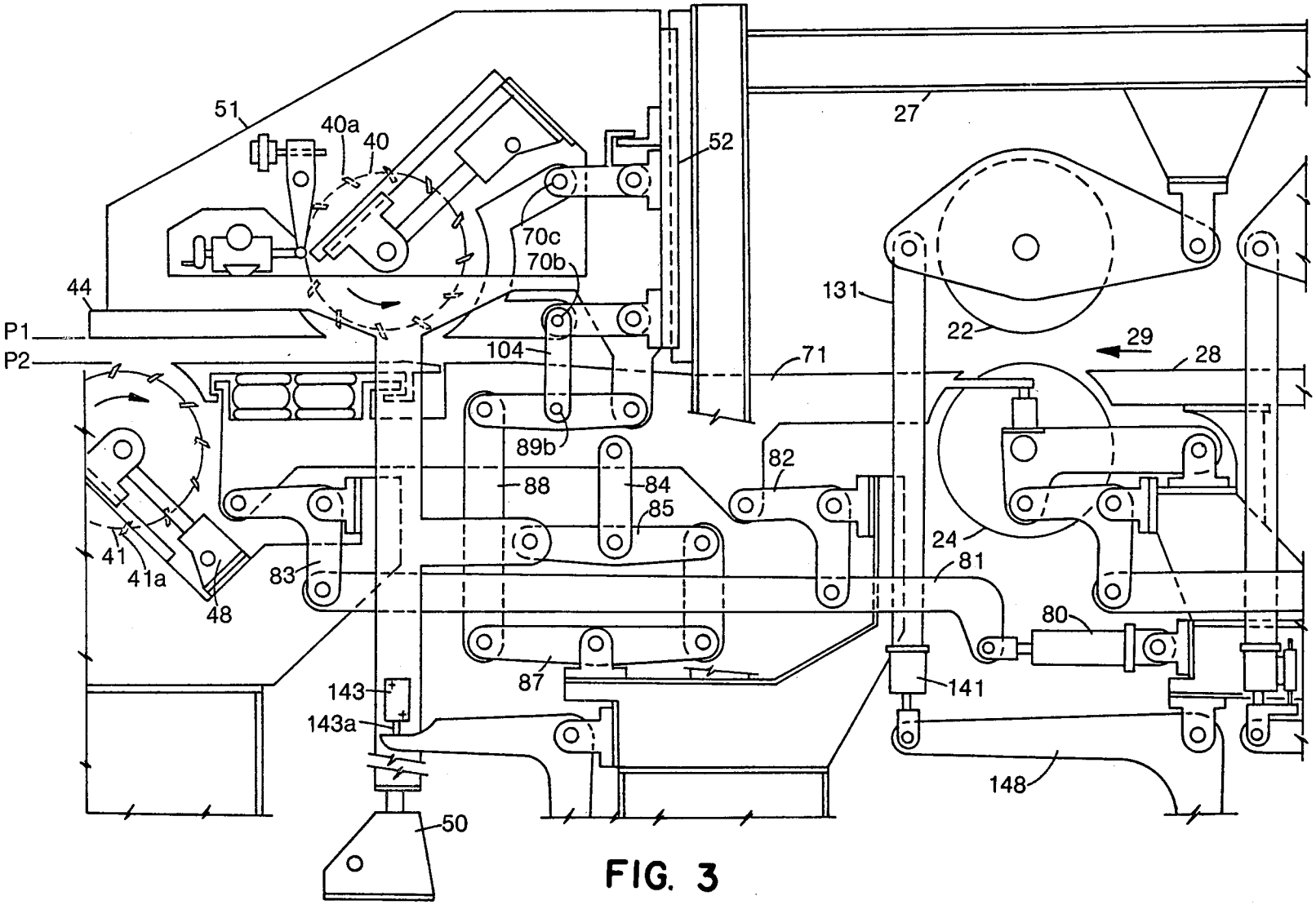
FIG. 3 is an enlarged partial schematic elevation, with some portions broken away, similar to FIG. 2, but showing another embodiment utilizing only one higher pressure hydraulic fluid source in contrast to the higher and lower pressure hydraulic fluid sources utilized in the embodiment of FIGS. 1 and 2.

Another Embodiment of Equal Planing Cut Mechanisms, Using Only One Higher Pressure Hydraulic Fluid Source and No Lower Pressure Fluid Source FIG. 3 is an enlarged view of the components necessary to provide the means of equal planing cuts from top lumber surface 72 and bottom lumber surface 73, which differs from the embodiment of the equal planing means shown in FIGS. 1 and 2, by replacing top platen cylinder 77 and platen mechanical servo valve 78, with top platen control link 104. It was shown in the first embodiment of the equal planing means, that the combination of top platen cylinder 77 and platen mechanical servo valve 78 in combination with the remaining elements of this equal planing means, would always return platen mechanical servo valve 78 to the null position, thereby providing a means whereby the distance between top platen pin 70*b* and tertiary lever pin 89*b* remained a fixed length. Therefore it will be realized that the replacement of the top platen cylinder 77 and platen mechanical servo valve 78 with fixed length top platen control link 104 will not change the equal positioning of top platen 70 and bottom platen 71, and thereby the equal planing cuts will be retained as taken from top lumber surface 72 and bottom lumber surface 73 of the sawed lumber. The way in which this equal planing means positions the elements has changed, whereby bottom platen cylinder 80 now is the means by which the force of top platen surface 70*a* bears on top lumber surface 72 of the lumber, and a substantially equal and opposed force from bottom platen surface 71*a* bears on bottom lumber surface 73 of the sawed lumber. The same force must now be capable of setting the equal planing means elements, thereby no longer having the capability of separately setting the contact forces on the sawed lumber, independent of the positioning force necessary to rapidly set the equal planing means.

Figure 4:
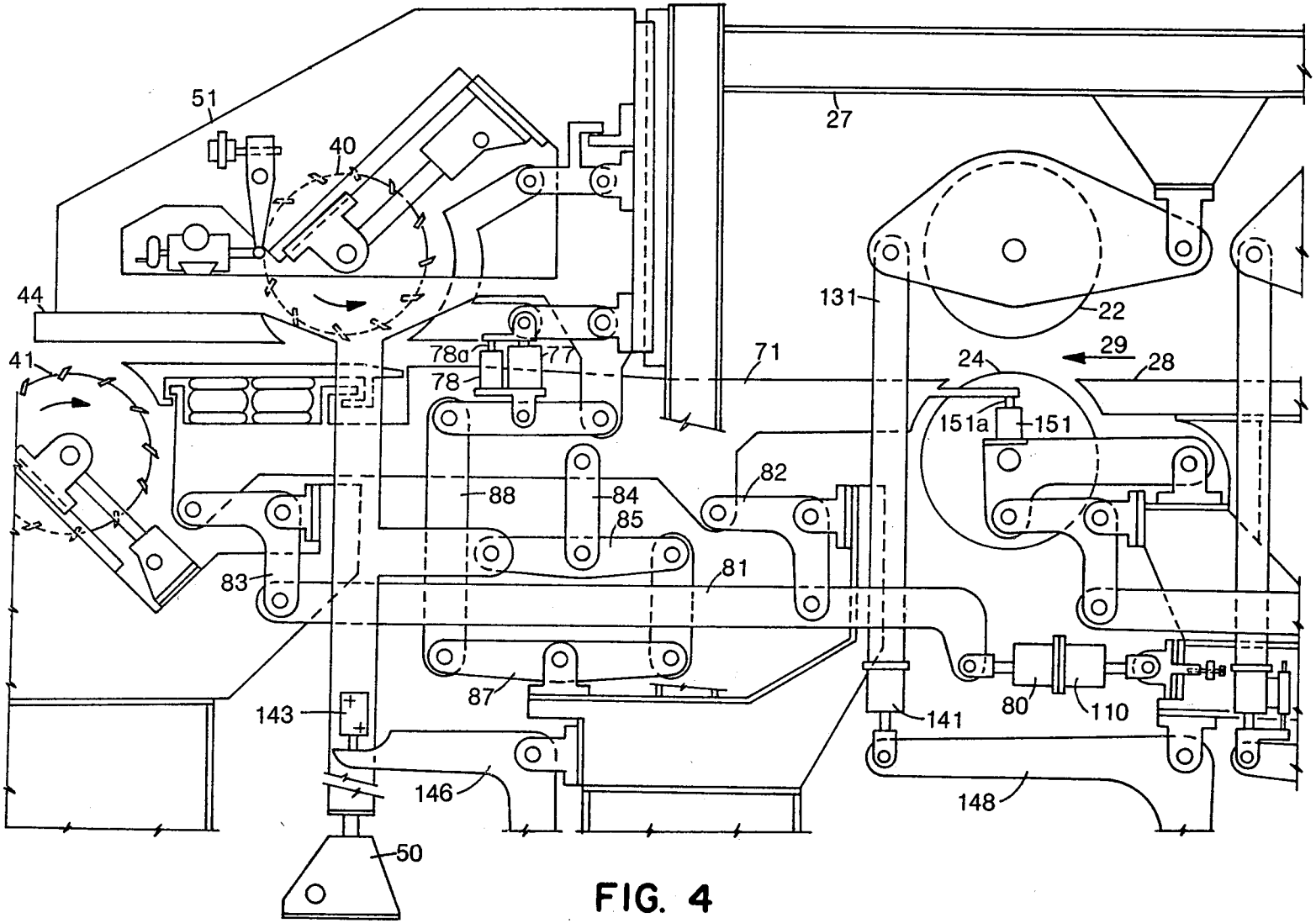
FIG. 4 is an enlarged partial schematic elevation, with some portions broken away, similar to FIGS. 2 and 3, but showing another embodiment capable of selecting a fixed bottom planing cut.
Figure 14:
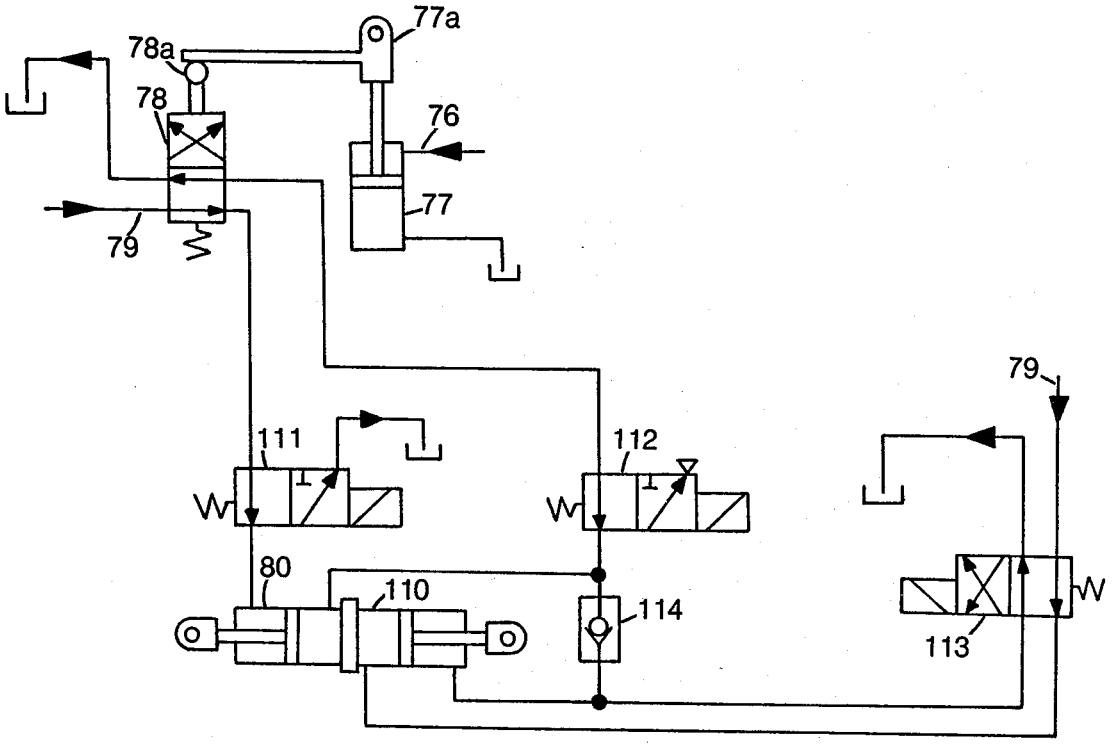
FIG. 14 is a schematic hydraulic diagram showing how an overall hydraulic system of a different embodiment is arranged to alternately and quickly, reversibly, convert the otherwise top and bottom equal planing machine for sawed lumber into a planing machine capable of making a set bottom planing cut of zero or deeper for special planing purposes to create other planed lumber products.

Another Embodiment of Equal Planing Cut Mechanisms Having an Overriding Lower Fixed Planing Cut Capability FIG. 4 is an enlarged view of the components necessary to provide the means of planing equal planing cuts from the top and bottom surfaces of the sawed lumber with the additional means of taking a fixed cut from bottom cutterhead 41, which differs from the equal planing means shown in FIGS. 1, 2, and 13, by adding a fixed cut cylinder 110 connected between bottom platen cylinder 80 and framing structure 27. As shown schematically in FIG. 14, when primary block valve 111, secondary block valve 112, and fixed cut valve 113 are in the de-energized position, this equal planing means functions exactly the same as the other equal planing means shown on FIGS. 1, 2, and 13.

It does not, however, when the primary block valve 111, secondary block valve 112, and fixed cut valve 113 are all energized, then the platen mechanical servo valve 78 is isolated from bottom platen cylinder 80, and also the bottom platen cylinder 80 is fully extended by means of high pressure fluid supply 79 flowing past bypass check valve 114, thereby raising bottom platen surface 71*a*. Moreover the fixed cut cylinder 110 is retracted lowering bottom platen surface 71*a*, a sufficient distance so the final position of bottom platen surface 71*a* is set below plane P2, a distance substantially equal to the desired fixed planing cut to be planed by the bottom cutterhead 41. The fixed cut cylinder 110 is attached to framing structure 27 with adjustable mounting means to allow adjusting the thickness of the fixed planing cut planed by bottom cutterhead 41. The means of this adjustment is well known in the art.

Sawed lumber entering this lumber planing machine embodiment is thereby planed with the fixed planing cut planed by bottom cutterhead 41, whereby the remaining planed thickness to be removed is planed by top cutterhead 40. The top platen 70 raises to allow the sawed lumber entry between top platen surface 70*a* and bottom platen surface 71*a*, with the force of top platen surface 70*a* on the sawed lumber controlled by top platen cylinder 77 by the same means as previously described. This method of rapidly changing the operation of this lumber planing machine embodiment from equal planing cuts planed by top cutterhead 40 and bottom cutterhead 41, to a means whereby a fixed cut is planed by bottom cutterhead 41, provides the overall means whereby sawed lumber with a large defect on one surface can be planed heavy on the defect side with a corresponding thin planing cut planed on the opposing surface. In addition, the rapid changeover from equal planing cuts, provides the means whereby the bottom cutterhead 41 planing cut is adjusted to zero thickness, thereby providing the overall means whereby the entire planing cut is planed by top cutterhead 40 as is required on some products in common manufacture requiring planing on one surface only.

The Automatic and Accurately Controlled Sharpening of the Cutterhead Knives

Figure 7:
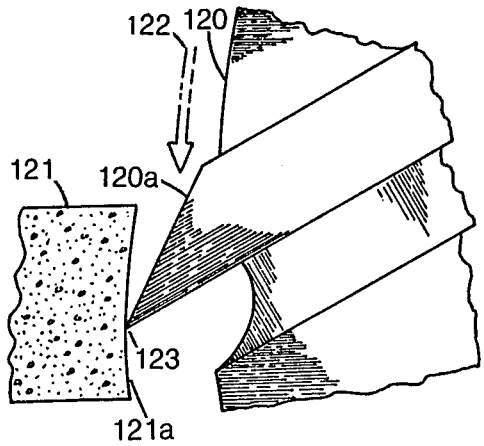
FIG. 7 is a partial enlarged elevational view, with portions broken away, of a portion of a cutterhead having a cutter rotating by a portion of a sharpening cutter stone to illustrate how the cutters are accurately sharpened.
Figure 9:
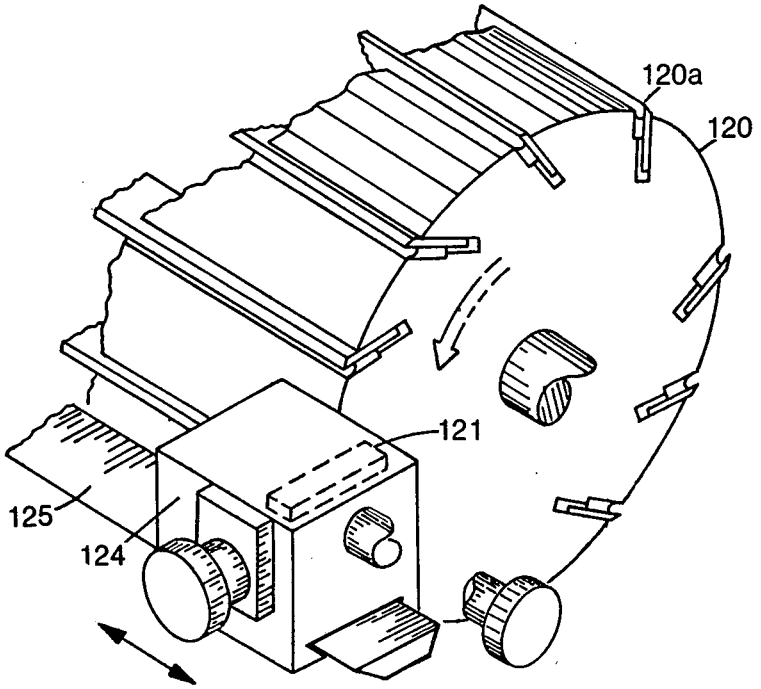
FIG. 9 is an enlarged perspective partial view, with portions broken away, showing the built in cutter sharpening cutter stone subassembly and its movement and adjustment features.

The operation of lumber planing machines requires frequent sharpening of typical cutterhead knives 120*a*, as shown in FIG. 7, wherein a segment of typical cutterhead 120 is illustrated with a typical cutterhead knife 120*a* contacting jointer stone 121. The cutterhead 120, as indicated by the rotation arrow 122, is rotating at a high rate of speed, while the jointer stone tip 121*a* contacts and sharpens its extreme knife edge 123. The jointer stone 121 is secured by jointer assembly 124 shown on FIG. 10, with means, whereby the jointer assembly 124 can be traversed along typical jointer way 125, also shown on FIG. 9, continuing along the entire length of typical cutterhead knives 120*a*, and whereby the rotation of this typical cutterhead 120 provides that all the typical cutterhead knives 120*a* will contact jointer stone 121, whereby sharpening all typical cutterhead knives 120*a*.

Figure 10:
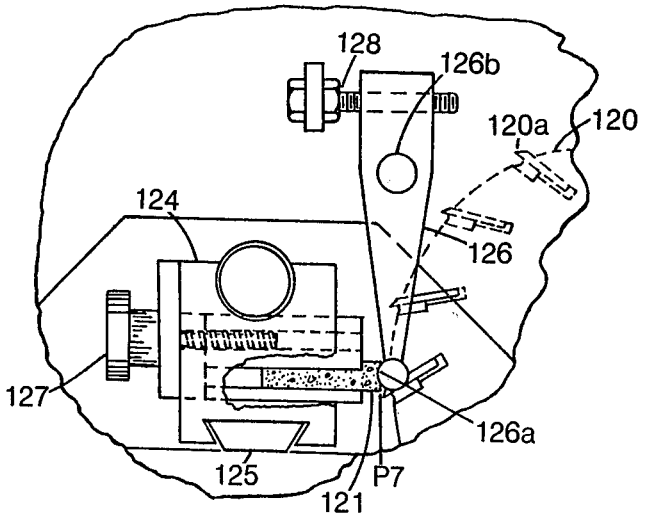
FIG. 10 is an enlarged schematic side elevation of the cutter sharpening adjustments and the cutter location adjustments undertaken by operating respective threaded adjustment assemblies, which insure the sharp rotating cutters will be cutting in the specified geometric plane.

The Accurate and Precision Constantly Available Adjustment SubAssemblies to Keep the Cutterhead Knives in Their Specified Rotative Cutting Positions, and to Likewise Keep the Jointer Stones in Their Specified Sharpening Positions, Wherein the Cutterhead Heads are Moved on Forty Five Degree Paths The jointer assembly 124 is provided with means whereby the travel along typical jointer way 125 extends beyond the travel of typical cutterhead knives 120*a* to a jointer stop 126 with jointer stop tip 126*a* as shown in FIG. 10. The tangent point of the jointer stop tip 126*a* lies substantially in plane P7 shown in FIG. 8 and in FIG. 10. The jointer stone 121 can be adjusted by means of adjusting screw 127, so the jointer stone tip 121*a* lies substantially in plane P7. The typical cutterhead 120 is provided with a typical jointing jack means to traverse the typical cutterhead 120 along plane P8 shown in FIG. 8, where angle A17 is the angle between plane P8 and P7, and where angle A17 is substantially one half of angle A18, where angle A18 is the angle measured between plate P6 and plane P7, and whereby plane P6, plane P7, and plane P8 intersect at a common line. If plane P7 is substantially normal to plane P6, then angle A17 is substantially 45 degrees. This geometry shows that if a typical cutterhead 120 is traversed along plane P8, until contact of typical cutterhead knives 120*a* is made with jointer stone tip 121*a* in plane P7, then the tangent point of the planing cut of the typical cutterhead 120 lies substantially in plane P6, which is substantially the planed surface position required for proper positioning of all cutterheads. This system of sharpening typical cutterhead knives 120*a*, thereby insures accurate positioning of the final planing position of all cutterheads. This exact geometry is provided by turning the jointer stop adjustment screw 128 to rotate the jointer stop 126 about jointer stop pivot 126*b* to adjust for wear in related components and to return the jointing means, whereby plane P6, plane P7, and plane P8 all intersect at a common line as shown in FIG. 8. This means of accurately and properly positioning typical cutterheads 120 and sharpening typical cutterhead knives 120*a* provides a precision means of positioning typical cutterheads, which are presently positioned on conventional lumber planing machines solely by an operator using his eyesight, hand skill and best judgment. This precise means of positioning typical cutterheads 120 and sharpening typical cutterhead knives 120*a* is incorporated on top cutterhead 40, bottom cutterhead 41, inside side cutterhead 42, and outside side cutterhead 43.

The Control and Adjustment of the Top Powered Feed Rolls

The powered feed rolls 21, 22, 23, 24, 25, and 26 which feed the lumber through this lumber planing machine in its various embodiments are automatically positioned. The first powered feed roll 21, second powered feed roll 22 and fifth powered feed roll 25 are indirectly positioned by means of the first roll link 130, second roll link 131, and fifth roll link 132, as these roll links directly position the first roll housing 21*a*, second roll housing 22*a*, and fifth roll housing 25*a*. These housings are positioned so the tangential lower surfaces of these powered feed rolls 21, 22, and 25 are automatically set at a nominal distance, say ⅛ inch, below the top lumber surface 72 of the sawed lumber, of an anticipated thickness. Thereafter the sawed lumber feeding through this lumber planing machine raises these powered feed rolls 21, 22, and 25 running against top lumber surface 72 and in so doing extends the top roll cylinders 140, 141, and 142, which provide a regulated force via a regulated fluid pressure source, to the top roll links 130, 131, and 132. This utilization of a regulated fluid pressure source is well known in this art.

Figure 11:
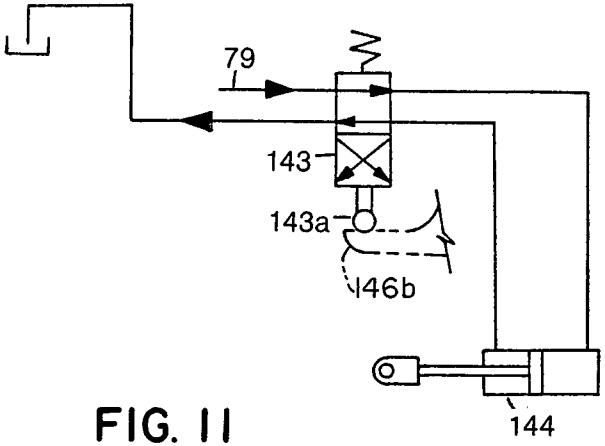
FIG. 11 is a schematic hydraulic diagram illustrating how the raising and lowering of the upper or top platen assembly, located ahead of the top cutter head is sensed and thereafter adjustments are undertaken to make corresponding height adjustments to the top feed rollers.

The means whereby this lumber planing machine in its various embodiments automatically positions these powered feed rolls 21, 22, and 25 is by utilizing a top roll mechanical servo valve 143 shown in FIGS. 1 and 11. This servo valve 143 positions the top roll servo cylinder 144, whereby a change in position of top cutterhead assembly 51 by means of thickness positioning jack 50 automatically changes the position of these powered feed rolls 21, 22, and 25, so they are substantially maintained in the same relative position to the top cutterhead assembly 51 as they were prior to the changed position of top cutterhead assembly 51.

When top cutterhead assembly 51 is positioned to a different planed lumber thickness setting, it is not important whether the position change was from a thin planed lumber setting to a thicker planed lumber setting or from a thick planed lumber setting to a thinner planed lumber setting, provided the change in position setting of the top cutterhead assembly 51 did not substantially change the relative position of the powered feed rolls 21, 22, and 25. The changed position setting of top cutterhead assembly 51 is described as follows from a thin planed lumber setting to a thicker planed lumber setting. As shown in FIG. 11, when top cutterhead assembly 51 is raised, the top roll mechanical servo valve 143 raises relative to top roll servo valve stem 143*a*, thereby releasing high pressure fluid from high pressure fluid supply 79. Therefore the top roll servo cylinder 144 is extended, which in turn extends top roll link 145, whereby top servo bell crank 146 pivots about top servo bell crank pivot 146*a*, raising bell crank servo contact point 146*b*, in turn raising the top roll servo valve stem 143*a* to the null position of the top roll mechanical servo valve 143. This null position is reached when the rise of bell crank servo contact point 146*b* is substantially equal to the rise of top cutterhead assembly 51. This position change of top roll link 145 also raises first roll link 130, second roll link 131, and fifth roll link 132 by means of first bell crank 147, second bell crank 148, and fifth bell crank 149, as these bell cranks are rotated about bell crank pivots 147*a*, 148*a*, and 149*a*. The top roll link 145 throughout its length is respectively connected to these bell cranks by the top roll link pins 145*a*, 145*b*, and 145*d*. The rotation of bell cranks 147, 148, and 149 raises bell crank pins 147*b*, 148*b*, and 149*b* connected respectively to first top roll cylinder 140, second top roll cylinder 141, and fifth top roll cylinder 142, which, being normally retracted, are then raised to in turn raise the first roll link 130, second roll link 131, and fifth roll link 132. Each of these roll links is raised a distance substantially equal to the rise of bell crank pins 147*b*, 148*b*, and 149*b*, to rotate in turn the roll housings 21*a*, 22*a*, and 25*a*, each respectively about their top roll pivots 21*b*, 22*b*, and 25*b*, thereby raising the tangential lower roll surfaces of the powered feed rolls 21, 22, and 25 substantially a distance equal to the rise of top cutterhead assembly 51. These raises being substantially equal because of the geometric shapes of the respective components and their utilization as is well known in this art.

Alternate Use of the Faster Revolving Fifth Feed Roll, Retracting It When Substantially Alike Thickness Lumber is Moving End to End Through the Machine This equal planing means, whereby equal planing cuts are planed from the top lumber surface 72 and bottom lumber surface 73, provides means whereby sawed lumber of varying thickness can be planed end to end. The preferred normal operation of this sawed lumber equal planing machine is with the fifth powered feed roll 25 raised above the surface of the planed top lumber surface to avoid roll marking. It is raised by extending fifth top roll cylinder 142. Thereafter the planed lumber is pushed through this lumber planing machine in its various embodiments, by the following planed lumber, i.e. planed board pushing directly on the end of the preceding planed lumber i.e. planed board. When however, a following sawed lumber, which is excessively thicker or thinner than the preceding planed lumber being pushed through this lumber planing machine, enters this machine it raises or lowers the first powered feed roll 21. This movement also thereby alternatively extends or retracts the first top roll cylinder 140, and the first signal cylinder 150, as shown in FIGS. 1 and 2. As a consequence hydraulic fluid under pressure is released via the first signal cylinder 150 to activate a signal device, not shown, resulting in the retraction of the fifth top roll cylinder 142, thereby lowering the faster revolving fifth powered feed roll 25 to contact an underlying top planed lumber surface and to pull the preceding planed lumber from this lumber planing machine. This lumber planing machine then quickly and automatically positions its equal planing means to receive and to plane the different sawed lumber of greater or less thickness, which could not be relied upon for clearing the preceding planed lumber from this planing machine.

In summary this signal, etc. means for powering planed lumber from this lumber planing machine is also utilized when lumber is not present to push planed lumber from the lumber planing machine, as well as when lumber pushing the planed lumber is excessively thicker or thinner than the preceding planed lumber. Such operation of the fifth and sixth powered feed rolls avoids any mismanufacture which might occur if a following board were otherwise allowed to butt the preceding board during the operation of this equal planing machine.

Positioning the Lower Entry Powered Feed Rolls

Figure 12:
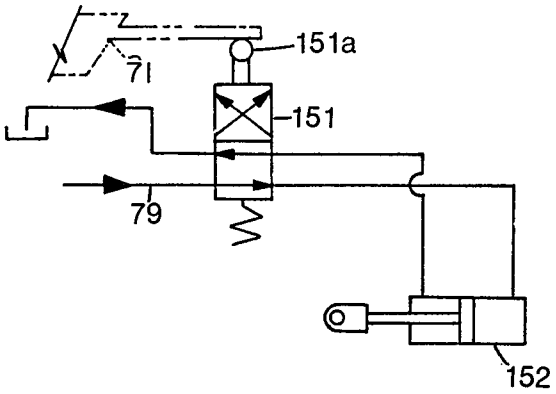
FIG. 12 is a schematic hydraulic diagram to show how the raising and lowering of the lower or bottom platen assembly located ahead of the top cutter head is sensed, and thereafter adjustments are undertaken to make corresponding height adjustments to the lower feed rollers.

The powered feed rolls 23 and 24 are positioned by a means, whereby the upper tangential surfaces of these powered feed rolls are maintained automatically, substantially at the same elevation as bottom platen surface 71*a*. This positioning means utilizes a bottom roll mechanical servo valve 151 shown in FIGS. 1 and 12 which initiates position changes of the bottom roll servo cylinder 152. Therefore a change in the position of bottom platen 71 automatically and equally initiates changes in the positions of the upper tangential surfaces of these powered feed rolls 23 and 24, to substantially maintain their upper tangential surfaces at the same elevation as bottom platen surface 71*a*.

When the bottom platen 71 is positioned to a new position, it is not important whether the position change was from a lower position to a higher position or from a higher position to a lower position, provided the change in position did not substantially change the relative position of the upper tangential surfaces of these powered feed rolls 23 and 24 relative to bottom platen surface 71*a*. The changed position setting of bottom platen 71 described, as follows, will be from a lower position to a higher position setting. When bottom platen 71 is raised, the bottom roll servo valve stem 151*a* raises relative to bottom roll mechanical servo valve 151, thereby releasing high pressure fluid from high pressure fluid supply 79 to extend the bottom roll servo cylinder 152. It in turn extends bottom roll link 153 connected to third bell crank 154 and fourth bell crank 155 by means of bottom bell crank pins 154*b* and 155*b*, and these bell cranks pivot about their respective bell crank pivots 154*a* and 155*a*. Consequently the powered feed rolls 23 and 24 are raised and also the bottom roll mechanical servo valve 151 is raised to its null position. When this null position is reached, then the rise of the bottom roll mechanical servo valve 151, the rise of bottom servo valve stem 151*a*, the rise of the bottom platen surface 71*a*, and the rise of the upper tangential surfaces of powered feed rolls 23 and 24, are all substantially equal, via the cooperation of the various geometric shapes of the related components. Moreover, these upper tangential surfaces raise equally with the bottom platen surface 71*a*, via these geometric shapes, as is well known in the art. This positioning of the third powered feed roll 23 and the fourth powered feed roll 24 is the means, whereby a bottom lumber surface 73 of sawed lumber entering this lumber planing machine is automatically positioned at the proper level with respect to the bottom platen surface 71*a* prior to planing by top cutterhead 40.

Another Embodiment Regarding Positioning the Lower Entry Feed Rolls

Figure 5:
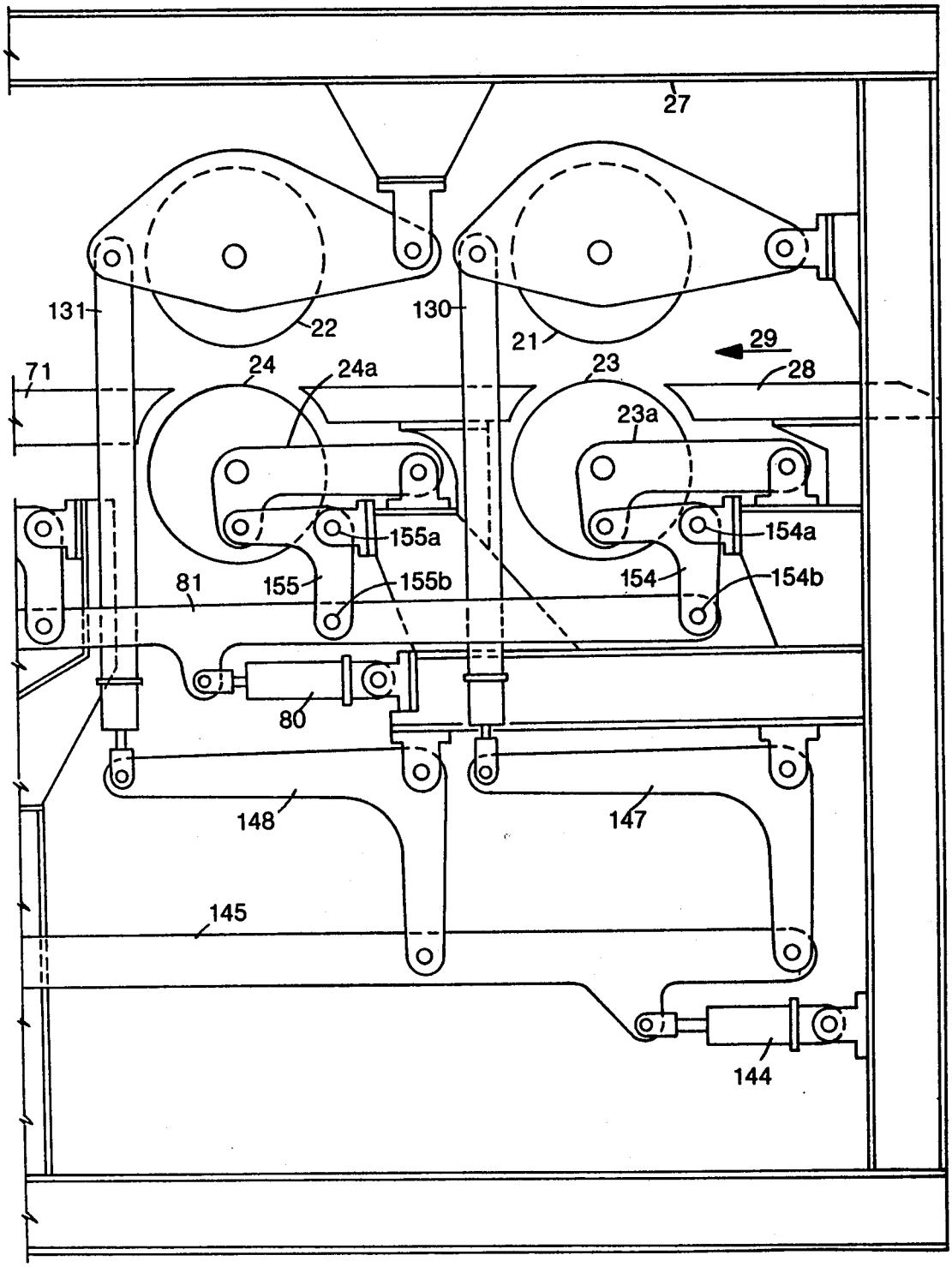
FIG. 5 is an enlarged partial schematic view showing another embodiment, wherein all of the hydraulic operations are combined throughout this planing machine and arranged to move all the adjusting mechanism, via one source of a high pressure hydraulic fluid, i.e., moving the platens, feed rollers, and cutterheads via only this one source of hydraulic fluid.

FIG. 5 is an enlarged elevation view of the components necessary to provide for the automatic positioning of powered feed rolls 23 and 24 whereby in this embodiment the positioning means eliminates the need for a bottom roll mechanical servo valve 151 and bottom roll servo cylinder 152. This new means extends bottom platen link 81, as particularly shown on FIG. 5, to connect to bottom bell crank pins 154*b* and 155*b* in lieu of link 153, whereby third bell crank 154 and fourth bell crank 155 pivot about bell crank pivots 154*a* and 155*a* respectively, when the elongated bottom platen link 81 extends to raise bottom platen surface 71*a*, thereby raising the upper tangential surfaces of the powered feed rolls 23 and 24, substantially equal to the rise of bottom platen surface 71*a*. This rise is undertaken substantially equally by utilizing means, whereby the geometric shapes of bell cranks 82, 83, 154, and 155 and bottom roll housings 23*a* and 24*a* are such that the rises of the upper tangential surfaces of powered feed rolls 23 and 24 are substantially equal to the rise of bottom platen surface 71*a*. These geometric shapes are well known in the art.

This means of positioning the third powered feed roll 23 and the fourth powered feed roll 24 requires fewer component parts to properly position these powered feed rolls. However, this means requires that the bottom platen cylinder 80 positions the powered feed rolls 23 and 24, in addition to positioning bottom platen 71.

Therefore the overall rapid positioning means required for the equal planing machine will not be quite as rapid, because more weight and mass of components are positioned, in contrast to the operation of the other embodiments.

I claim:

1. A method of planing sawed lumber to automatically plane equal thicknesses of wood from both the top and bottom of the lumber and to plane sides of the lumber to produce a planed board of a specified cross sectional size, in so doing keeping the removed planed waste wood to a minimum amount, comprising the steps of:

(a) positioning a powered top planing cutter at a selectable planing height and at a location ahead of a bottom planing cutter to plane lumber to a preselected thickness;

(b) positioning a powered bottom planing cutter at a fixed planing height and at a location beyond the powered top planing cutter to plane lumber to the preselected thickness;

(c) positioning a pair of spaced side planing cutters at a selectable distance apart to plane lumber to a preselected width and at a location beyond the powered bottom planing cutter;

(d) positioning a first top platen at a height adjustable location ahead of the powered top planing cutter and locating the top platen to guide an oncoming board of sawed lumber to the powered top planing cutter for a specified minimum selected depth of a planing cut;

(e) positioning a first bottom platen at a height adjustable location ahead of the powered top planing cutter and at a location immediately below the first top platen for a specified minimum selected depth of a planing cut to be undertaken by the powered bottom planing cutter equalling the specified minimum selected depth of a planing cut to be undertaken by the powered top planing cutter;

(f) operating the powered top and bottom planing cutters and the side planing cutters;

(g) feeding a board of oncoming sawed lumber between the first top and first bottom platens;

(h) sensing any upward movement of the first top platen caused by the entering end of the oncoming board of sawed lumber;

(i) adjusting immediately the relative positions of the first top platen and first bottom platen so each platen is equally moved to center the oncoming board of sawed lumber between the planing cut depths of the respective powered top and bottom planing cutters thereby preparing for the equal planing cuts of the same depth of wood from the respective top and bottom of the board of lumber; and (j) feeding the sawed lumber respectively past the operating powered top, bottom and side cutters, thereby planing the same depth of wood from the respective top and bottom of the board of lumber and planing wood from both sides of the board of lumber to produce a planed board of lumber of the preselected cross sectional size.

2. A method of planing sawed lumber, as claimed in claim 1, wherein during the positioning of the powered top, bottom, and spaced side planing cutters, bias forces are applied moving these cutters in a forty five degree direction to contact stops which thereafter insure the planing cuts will be occurring in the specified locale.

3. A method of planing sawed lumber, as claimed in claim 1, wherein during the positioning of the powered top, bottom, and spaced side planing cutters, bias forces are applied moving these cutters in a forty five degree direction to contact cutter sharpening stones, which thereafter serve in sharpening the cutters and to insure the planing cuts will be occurring in the specified locale.

4. A method of planing sawed lumber as claimed in claim 1, 2, or 3 comprising, in addition, the step of sensing any movement of a first bottom platen, and then the step of providing for and operating lower powered feed rollers located ahead of the first bottom platen at the same sensed operating height of the first bottom platen.

5. A method of planing sawed lumber, as claimed in claim 4, comprising, in addition, the step of providing for and operating a lower powered feed roller located beyond the powered bottom planing cutter at a fixed height position relative to the position of the powered bottom planing cutter.

6. A method of planing sawed lumber, as claimed in claim 1, 2 or 3, in addition, during the positioning of the powered top planing cutter, the step of sensing such movement of the powered top planing cutter, and then the step of providing for and operating top powered feed rollers located ahead of the first top platen at the same sensed operating height of the powered top planing cutter.

7. A method of planing sawed lumber, as claimed in claim 6, comprising in addition, the step of providing for and operating a top powered feed roller located beyond the spaced side cutters at the same sensed operating height of the powered top planing cutter.

8. A method of planing sawed lumber, as claimed in claim 1, comprising, in addition, the step of sensing any movement of a first bottom platen, and then the step of providing for and operating lower powered feed rollers located ahead of the first bottom platen at the same sensed operating height of the first bottom platen; and during the positioning of the powered top planing cutter, in addition, the step of sensing such movement of the powered top planing cutter, and then the step of providing for and operating top powered feed rollers located ahead of the first top platen at the same sensed operating height of the powered top planing cutter.

9. A method of planing sawed lumber, as claimed in claim 8, comprising in addition, the step of providing for and operating a top powered feed roller located beyond the spaced side cutters at the same sensed operating height of the powered top planing cutter.

10. A method of planing sawed lumber, as claimed in claim 9, comprising the steps of retracting the top powered feed roller located beyond the spaced side cutters during operating times, when oncoming boards of sawed lumber have similar thicknesses, sensing oncoming boards of sawed lumber which have dissimilar thicknesses, as one follows the other, and immediately returning this top powered feed roller, so the planed board will be positively contacted conveyed out of the way of oncoming boards by this returned top powered feed roller.

11. A machine for planing the upper and lower surfaces of a pre-sawn board longitudinally advanced through said machine, comprising:

(a) a frame having front and rear ends;

(b) rearwardly disposed lower cutterhead means connected to said frame and adapted for planing on a first pre-selected plane said lower surface of said advancing board;

(c) forwardly disposed upper displaceable cutterhead means connected to said frame and adapted for planing on a second pre-selected plane said upper surface of said advancing board;

(d) said upper cutterhead means being displaceable for planing said board to a pre-selected thickness, said pre-selected thickness determined by a distance separating said first and second planes;

(e) roller means disposed on said frame at generally said front end for longitudinally advancing a board to said rear end between said upper and lower cutterhead means;

(f) upper displaceable platen means associated with said upper cutterhead means and connected to said frame intermediate said upper cutterhead means and said front end and including means mounted on said frame adapting said upper platen means to be displaced by said advancing board;

(g) lower displaceable platen means operatively connected to and cooperating with said upper platen means;

(h) said upper and lower platen means being interconnected by means for causing separation of said platens by said advancing board a distance equal to said board thickness; and, (i) whereby, displacement of said upper platen means causes oppositely directed associated displacement of said lower platen means and cooperating associated displacement of said upper platen means and whereby said distance separating said platens is maintained constant by said board so that said advancing board is aligned by said platens so that said upper and said lower cutterhead means plane said board on said first and second planes for thereby planing equal thicknesses from said upper and lower board surfaces so that said planed board has said pre-selected thickness.

12. The machine as defined in claim 11, wherein:

(a) a first cylinder and piston assembly is connected to said upper platen means for monitoring displacement by said board of said upper platen means;

(b) a second cylinder and piston assembly is mounted to said frame;

(c) linkage means connecting said first and second cylinder and piston assemblies with said upper and lower platen means; and, (d) servo means associated with said first and second cylinder and piston assemblies whereby displacement of said first cylinder and piston assembly causes cooperative displacement of said second cylinder and piston assembly to adjust said linkage means thereby for aligning said upper and lower platen means with said first and second planes to thereby permit equal thickness planing of said advancing board.

13. The machine as defined in claim 12, wherein:

(a) said upper cutterhead means is mounted to an upper cutterhead assembly; and, (b) displacement means connected to said upper cutterhead assembly and said frame for displacing said upper cutterhead assembly and said upper cutterhead means thereby for changing said pre-selected thickness by displacing said second plane therewith.

14. The machine as defined in claim 13, wherein:

(a) said displacement means includes cylinder and piston means.

15. The machine as defined in claim 13, further comprising:

(a) pressure plate means mounted to said upper cutterhead assembly generally rearwardly of said upper cutterhead means and aligned with said second plane for providing a bearing surface; and, (b) bottom floating platen means mounted to said frame generally forwardly of said lower cutterhead means and aligned with said lower platen means for pressing said advancing board upper surface against said pressure plate means for maintaining alignment of said board lower surface with said first plane.

16. The machine as defined in claim 15, wherein:

(a) said bottom floating platen means includes a fluid pressure positioner for aligning said bottom floating platen means.

17. The machine as defined in claim 12, wherein:

(a) said bottom cutterhead means is mounted to a bottom cutterhead assembly.

18. The machine as defined in claim 17, including:

(a) displacement means connected to said bottom cutterhead assembly and said bottom cutterhead means for displacing said bottom cutterhead means whereby said bottom platen means maintaining alignment with said first plane to permit unequal thickness planing of said board thereby.

19. The machine as defined in claim 18, wherein:

(a) said displacement means includes a jointing jack.

20. The machine as defined in claim 13, wherein:

(a) said roller means is connected to said upper cutterhead assembly displacement means for being cooperatively displaced therewith.

21. The machine as defined in claim 11, further comprising:

(a) first and second spaced side cutterhead means mounted to said frame generally rearwardly of said bottom cutterhead means for planing sides of said board to a pre-selected width.

22. The machine as defined in claim 21, wherein:

(a) each of said side cutterhead means is mounted to a side cutterhead assembly; and, (b) displacement means connected to each of said side cutterhead assemblies and said frame for changing said pre-selected width.

23. The machine as defined in claim 22, wherein:

(a) said side cutterhead assemblies displacement means includes a cylinder and piston assembly.

24. The machine as defined in claim 20, further comprising:

(a) rear roller means displaceably mounted to said rear end for longitudinally rearwardly advancing an advancing board during displacement of said forwardly disposed roller means whereby said rear roller means is displaced from a free to a board-contact position by displacement of said forwardly disposed roller means during changing of said pre-selected thickness.

25. The machine as defined in claim 21, wherein:

(a) each of said cutterhead means is cylindrically shaped; and, (b) a plurality of circumferentially disposed cutters secured to each of said cutterhead means for planing said board by contact therewith.

26. The machine as defined in claim 25, wherein:

(a) sharpening assembly means is connected to said frame adjacent each of said cutterhead means for sharpening said cutters.

27. The machine as defined in claim 26, wherein:

(a) each of said sharpening assembly means includes stop means for insuring alignment of said cutters.

28. The machine as defined in claim 13, including:

(a) stop means secured to said upper cutterhead assembly; and, (b) a stop arm mounted to said upper platen means for engaging said stop means during lowering of said upper platen means to prevent further lowering thereof.

29. The machine as defined in claim 11, including:

(a) a control link connected to said upper platen means for being cooperatively displaced by displacement of said upper platen means;

(b) a cylinder and piston assembly connected to said frame; and, (c) linkage means connected to said control link and to said cylinder and piston assembly and said upper and lower platen means whereby displacement of said upper platen means and said control link thereby causes cooperative displacement of said cylinder and piston assembly to thereby adjust said linkage means and align said upper and lower platen means with said first and second planes for thereby permitting equal thickness planing of said advancing board.

30. The machine as defined in claim 11, including:

(a) a fixed cut cylinder and piston assembly connected to said frame and said lower platen means for displacing said lower platen means to thereby permit planing of a pre-selected thickness from said board lower surface.

31. The machine as defined in claim 13, including:

(a) displacement means connected to said upper cutterhead assembly and said upper cutterhead means for displacing said upper cutterhead means.

32. The machine as defined in claim 31, wherein:

(a) said displacement means includes a jointing jack.

* * * * *